United States Patent [19]

Patterson

[11] 4,055,690

[45] Oct. 25, 1977

[54] STAR ORNAMENT AND CARD

[76] Inventor: Michael P. Patterson, 11701 W. River Hills Drive No. 206, Burnsville, Minn. 55337

[21] Appl. No.: 685,817

[22] Filed: May 12, 1976

[51] Int. Cl.[2] ..... B65D 65/28

[52] U.S. Cl. ..... 428/9; 40/124.1; 40/128; 46/37; 229/92.8; 428/11; 428/43

[58] Field of Search ..... 428/7, 8, 9, 11, 124, 428/125, 133, 43, 542; 46/31, 35–37; 40/124.1, 128; 229/92.8; D11/121, 125–129

[56] References Cited

U.S. PATENT DOCUMENTS

| | | | |
|---|---|---|---|
| 927,499 | 7/1909 | Davis | 46/35 X |
| 1,703,438 | 2/1929 | Wilson et al. | 428/8 |
| 1,912,505 | 6/1933 | Weston | 220/22 |
| 2,081,893 | 5/1937 | Lozier | 428/11 |
| 2,616,199 | 11/1952 | Robins | 428/9 |
| 2,659,993 | 11/1953 | Raymond | 428/7 |
| 2,977,701 | 4/1961 | Louderback | 428/8 |
| D. 164,323 | 8/1951 | Robins | D11/129 X |

*Primary Examiner*—William J. Van Balen
*Assistant Examiner*—Henry F. Epstein
*Attorney, Agent, or Firm*—Dugger, Johnson & Westman

[57] ABSTRACT

A greeting card includes a three dimensional hanging ornament comprising a star-like configuration that is erected in a unique manner after it has been punched out from the card. The card is oriented to provide a greeting message on one panel, which can be removed for keeping, while the other panels form the punched out star and can be erected into a hanging ornament.

2 Claims, 3 Drawing Figures

STAR ORNAMENT AND CARD

BACKGROUND OF THE INVENTION

1. Field of the Invention

The present invention relates to a greeting card which has a folding star type ornament as a punch on the panels of the ornament.

2. Prior Art

In the prior art various greeting card ornament combinations are shown including U.S. Pat. No. 2,616,199 which comprises a single sheet of paper forming a greeting card which may be formed into a three dimensional ornament for hanging. Additionally, other ornaments which are not formed from greeting cards have been made, for example an ornament for a christmas tree or the like is shown in U.S. Pat.No. 1,472,520. This is a folding type ornament that is rather difficult to erect, and cannot easily be punched out of a greeting card. Another three dimensional ornament from a decorative greeting card is shown in U.S. Pat. No. D 164,323.

An educational device which has a center mounting member and interlocking disc shaped portions is shown in U.S. Pat. No. 927,499.

Various other ornaments have been advanced, of course and reference is made to the prior art discussion in my co-pending U.S. Application Ser. No. 685,820, Filed May 12, 1976 and entitled Greeting Card And Ornament.

SUMMARY OF THE INVENTION

The present invention relates to a greeting card which has folding punch out ornament sections which can be mounted onto a center support member and form a three dimensional multi-panel ornament. Six radially extending panel portions are made by folding three punch out portions into V configurations to form two of the panel portions for the ornament. The folded panels are slipped over and interlocked with a center mounting member. The mounting member comprises a disc that has tapered recesses for receiving the mating panel portions and guiding them into position so that the six panel portions are evenly spaced around the periphery.

BRIEF DESCRIBTION OF THE DRAWINGS

DESCRIPTION OF THE PREFERRED EMBODIMENT

Figures 1, 2, 3:
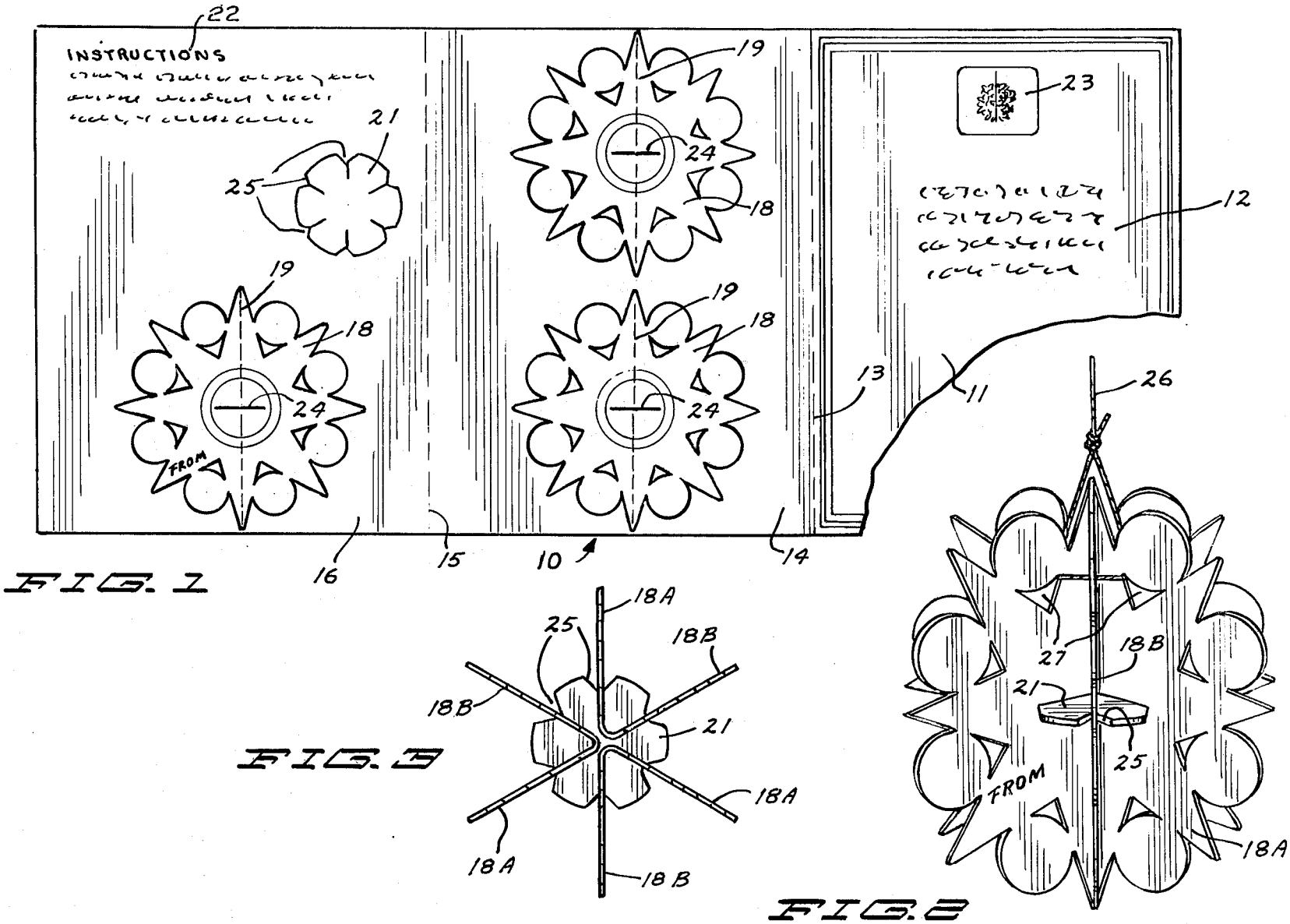
FIG. 1 is a flat layout, with portion of one panel broken away, of a greeting card having an ornament made according to the present invention formed on two of the panels of the card.
FIG. 2 is a perspective view of the assembled ornament embodied in the greeting card of FIG. 1.
FIG. 3 is a top plan view of the ornament of FIG. 2.

In FIG. 1, a flat layout of a greeting card illustrated generally at 10 is shown. The greeting card has a front panel 11 on which a verse or written salutation 12 is printed. This front panel 11, and the face on which the verse 12 is written forms the outer surface of the card. The card panel 11 is joined along a perforated line or tear line 13 to a second card panel 14, which in turn is joined along a scored fold line 15 with the third panel 16. The panels 14 and 16 carry punch out ornament portions indicated generally at 18 that as shown form a star-like design. Each of the punch outs 18 is made with a scored fold line 19 down the center, and this will permit the panels 18 to be folded to form two panel portions 18A and 18B joined at an apex to form a V shape in plan view as shown in FIG. 3. In addition, the third card panel 16 has a disc member 21 formed thereon, which can be punched out and used for mounting the panel 18. The instructions are printed on the surface of the third card panel 16 as indicated at 22 and the surface on which the instructions are printed will be an interior face of the card and will be visible as soon as the front panel 11 is opened after the card has been removed from its mailing envelope. Also, it should be noted that the front panel 10 has a representation of the assembled ornament indicated at 23 thereon so that the receiver knows what the punch out portions should look like immediately. The three card panels are folded so that the third panel is between the first and second card panels.

After the individual star panels 18 have been punched out, and folded along the score lines 19 to form the two side panels 18A and 18B, the V shaped members are slipped over the center member 21 sliding the slits 24 that are present in each of the individual snowflake panels 18 over the edges of the center member. It should be noted that each of the legs or panels 18A and 18B will be guided onto the center support member 21 by notches 25 that are spaced, as shown, 60°apart so the individual panels 18A and 18B of each of the snowflake portions will be properly angularly positioned relative to another. The member 21 may also have short slits as shown.

It can be seen that the apexes formed at scored fold lines 19, which are shown in FIG. 3, will be close together at the center of the mounting member 21. Then, the ornament can be suspended from a cord 26 that is passed through provided openings 27 forming parts of the punch outs, and the ornament can be hung in any desired location such as a christmas tree or some place where it will take the appearance of a mobile work of art. The panel members 18A and 18B extend radially from the enter axis of the center member 21.

The unique folding and assembly of the star provides the ornament with ease of erection, and uniforn panels or legs to provide an attractive appearance for the ornament.

It should also be noted that the front panel 11 can be removed from the other panels of the card long the perforated line 13 and can be kept as a remembrance or as a permanent record.

It should be noted that the signature space for the signing by the party sending the card is on the third panel 16, and is on one of the punch out portions. The name of the person who sent the card will have his name on the ornament.

The same folding of panels into V shapes and mounting the folded V panels onto a center member can be used for snowflake type ornaments or with any ornamental edge configuration.

What is claimed is

1. An ornament which may be assembled from a greeting card comprising a flat disc-like mounting member a plurality of flat panels of generally identical peripheral edge shape, a separate transversely extending bisecting score line in the center portions of each of said panels, each of said panels being folded along the score lines to form a pair of panel portions joined at an apex and forming a V, slit means in said panel portions extending across the folded edge and terminating short of the peripheral edges of the respective panel and of size to receive said mounting member whereby said mounting member retains said panel portions in a generally V shape with the panel portions extending generally radially from the center of said disc-like mounting member and wherein said mounting member has a plurality of notches and teeth defined in its peripheral edge spaced annularly around said member, said panel portions of each folded panel fitting into an associated notch and being held thereby in a desired radial position.

2. The combination of claim 1 wherein said slit means is at right angles to the fold lines of the associated panels and substantially midway between the opposite ends of the folded edge.

* * * * *